United States Patent [19]

Heller

[11] 4,108,690

[45] Aug. 22, 1978

[54] METHOD FOR PRODUCING AN AMORPHOUS, LIGHT WEIGHT CALCIUM PHOSPHATE COATING ON FERROUS METAL SURFACES

[75] Inventor: Ferdinand P. Heller, Ambler, Pa.

[73] Assignee: Amchem Products, Inc., Ambler, Pa.

[21] Appl. No.: 764,096

[22] Filed: Jan. 31, 1977

Related U.S. Application Data

[63] Continuation-in-part of Ser. No. 674,024, Apr. 5, 1976, abandoned.

[51] Int. Cl.[2] ..... C23F 7/10

[52] U.S. Cl. ..... 148/6.15 R; 148/31.5; 148/6.16

[58] Field of Search ..... 148/6.15 R, 6.16

[56] References Cited

U.S. PATENT DOCUMENTS

| | | | |
|---|---|---|---|
| 3,729,346 | 4/1973 | Gotta | 148/6.15 R |
| 3,810,792 | 5/1974 | Ries | 148/6.15 R |

FOREIGN PATENT DOCUMENTS

| | | | |
|---|---|---|---|
| 2,098,832 | 3/1972 | France | 148/6.15 R |

OTHER PUBLICATIONS

Satyanandham, Metal Finishing, Sep. 1968, pp. 52, 53, 58.

Wiederholt, The Chemical Surface Treatment of Metals, 1965, Robert Draper Ltd. p. 107.

*Primary Examiner*—Ralph S. Kendall
*Attorney, Agent, or Firm*—Dale Lynn Carlson

[57] ABSTRACT

A method is disclosed for producing a non-crystalline, light weight tightly adherent coating of calcium phosphate on ferrous metal surfaces. In this method, the ferrous metal surface is treated with a coating solution containing calcium phosphate together with an oxidizing agent at a pH which closely approaches but does not exceed the saturation point of the calcium phosphate in solution. In practicing the method of this invention, the calcium phosphate content of the coating bath is preselected from the range of from about 0.01 to about 1.0 moles per liter as measured by the $Ca^{++}$ cation. Next, a bath temperature of from about 50° F. to about 160° F. is selected. The pH of the bath is raised to a pH approaching but not exceeding the saturation point of calcium phosphate at the selected temperature and the bath is brought to the selected temperature.

Coating of the ferrous metal with the calcium phosphate solution is accomplished by conventional dip or spray methods. The resultant coating, though amorphous and with very low coating weight, provides the same superior bonding characteristics associated with heavier and crystalline prior art phosphate coating materials.

14 Claims, No Drawings

METHOD FOR PRODUCING AN AMORPHOUS, LIGHT WEIGHT CALCIUM PHOSPHATE COATING ON FERROUS METAL SURFACES

This application is a Continuation In Part of application Ser. No. 674,024, filed on Apr. 5, 1976 now abandoned.

BACKGROUND OF THE INVENTION (A) Field of the Invention

This invention relates to metal coating and more particularly to solid metal coating.

(B) Prior Art

Processes for producing heavy metal crystalline phosphate coatings on ferrous metal surfaces to insure good bonding of subsequent paint coats are well known in the art. Zinc phosphate in particular has been in general use for decades for this purpose, although other metals, including cadmium, calcium and manganese phosphate have been suggested.

Several problems are associated with phosphate coatings. The phosphate coating of metal so as to achieve the desired end metal product is not a simple process. One difficulty has been found to lie in the peculiar properties of heavy metal phosphates themselves. For example, as would ordinarily be expected, deposition coating of a metal surface is accomplished with more facility the higher the temperature due to an increasing chemical activity with increasing temperatures. Heavy metal phosphates, however, have the property of inverse solubility. That is, their solubility decreases as temperature increases. Since low solubility also means greater ease in securing a deposition type coating, the coating process is thus doubly expedited when performed at elevated temperatures. The boiling point of the acid phosphate solution has been a common temperature. Unfortunately, heated solutions are more difficult to handle, require larger expenditures of power to keep them in the heated state, and tend to precipitate out on heating coils or the hotter parts of the retaining tanks.

A second problem, especially with zinc phosphate coatings relate to their high price.

These problems being well known in the art for years, there has been an ongoing, long felt desire to perfect a coating process which may be operated over a wide range of temperatures, especially at temperatures lower than the boiling point of the phosphate solution and which will, secondly be economical.

Unfortunately in regard to using a lower temperature, the result is a greater solubility of metal phosphate, with concurrent reduction of metal phosphate available to deposit.

One 1940's prior art reference, U.S. Pat. No. 2,316,811 proposes solving the high solubility at low temperature problem by raising the pH such that a supersaturated solution of at best 20% is produced at the temperature (60° F. to 129° F.) for the concentration of metal phosphate utilized, thereby maximizing the amount of metal phosphate available to be deposited. Such a procedure raises a host of new problems inasmuch as the pH of the coating solution is itself critical for good results. First of all, any supersaturated solution is by its nature only semi-stable and consequently highly subject to desaturating with resultant sludge production. Furthermore, at this high a pH no coating will result even though the solution is supersaturated with metal phosphate because at very high pH's there is no free acid ($H^+$) present anymore. The lack of free acid ($H^+$) being present is fatal to a satisfactory rate in the deposition process because the acid initiates the process of depositing the phosphate coating on the metal surface. The aforementioned reference overcomes this rate problem by utilizing an oxidizing agent as an initiator to generate the requisite initial free acid. This same reference is directed toward zinc phosphate solutions, but discloses calcium, cadmium, and manganese as heavy metal equivalents presumed utilizable in the same manner, although no examples of calcium are disclosed.

A few years later, German Pat. No. 741,937 indicates the reason for the total lack of examples in regard to calcium phosphate. Although this latter reference attempted calcium phosphate at lower than boiling temperatures and with what appears to be both supersaturated and non-supersaturated solution, ultimately the only satisfactory adherent coating utilizing calcium phosphate was achieved at the previously known prior art combination of high temperature (98° C) and low (2.62) pH. On the other hand, low temperatures and high pH's were disclosed as producing satisfactory zinc phosphate coating, thus confirming the earlier work in regard to zinc phosphate. Low temperature, adherent calcium phosphate undercoats remained an unsolved problem.

Since this very early work, much additional work has been done to overcome various problems with, for example, the oxidizers (for example U.S. Pat. No. 2,351,605). Other than this, some coatings are known today which combine zinc and calcium phosphate. However, no methods are known which disclose the production of calcium phosphate coatings especially processes utilizable over a wide temperature range. Zinc phosphates, in spite of their higher price, have thus reigned supreme and unchallenged.

SUMMARY OF THE INVENTION

It has been found that the aforementioned prior art problems may be overcome by the method of this invention in which a calcium phosphate coating solution is provided wherein low concentrations of calcium phosphate, minimal oxide accelerators, and relatively high pH are combined over a wide temperature range in critical ratios to each other so as to produce a superior coating. Furthermore, the coating produced by the method of this invention is a new type coating characterized by non-crystalline (amorphous) structure and a very low coating weight. This coating in spite of these physical characteristics perfoms equally well when compared with prior art conventional heavier weight, crystalline coatings.

The concentration of calcium phosphate utilizable for this invention is within the range of from about 0.1 to about 1.0 moles per liter of bath solution as measured by calcium cation ($Ca^{++}$). Accelerator, in the form of an oxidizing agent such as sodium nitrite is also utilized in the process. If the accelerator is sodium nitrite for example, no more than about 100 parts per million is required. Any bath temperature between about 50° F to about 160° F may be utilized. But, when it is determined what bath temperature is to be the chosen one, the solution pH is adjusted, if necessary, with any alkaline material such as calcium carbonate, sodium hydroxide, potassium hydroxide, ammonium hydroxide, sodium carbonate, potassium carbonate or any other alkaline material which raises the pH but does not interfere with coating. The pH should preferably be adjusted to above 3.0 but not so high as to exceed the saturation point of calcium phosphate at that temperature and concentration level. Metal pieces are then coated with the coating solution by conventional methods such as by dipping or spraying.

DETAILED DESCRIPTION

Ferrous metals as hereinafter referred to, include iron and its alloys, especially, but not limited to steel.

Percent as used herein means by weight unless otherwise so denoted.

In a typical example by which the method of this invention may be practiced, a coating solution is provided first as a concentrate of the following ratio:

Calcium carbonate (98.5% pure) . . . 9.28%
Phosphoric acid (as a 75% solution) . . . 33.09%
Water to make . . . 100.00%

From this concentration, which is 1.0 molar in calcium (as $Ca^{++}$), a coating bath is made by diluting each liter of the concentrate with sufficient water to make a 0.025 molar (as measured by $Ca^{++}$) bath solution. In this example, a bath temperature of 100° F. is selected and based on this temperature and the concentration of calcium phosphate present, calcium carbonate is added to the bath until pH of up to 3.7 to 3.8 is reached. Ten grams of sodium nitrite (sufficient to make 250 ppm) are also added. The bath is then heated to the 100° F. temperature at which the process is to be run.

In the operation of the process of this invention, ferrous metal articles such as steel panels are prepared for the coating process of this invention by a cleaning and degreasing step following methods well known in the art. Following the cleaning step, the panels are rinsed in water. The cleaned panels are then spray coated with the calcium phosphate solution as prepared above. Coating contact time naturally depends on the delivery rate and other design parameters of the equipment, but utilizing conventional equipment, 60 seconds is in general a suitable time for this example.

Following the spray coating of the calcium phosphate the panels are preferably rinsed with water and dried. A final "after" rinse is performed to enhance corrosion resistance. The "after" rinse, which utilizes hexavalent chromates or other suitable materials for this purpose is well known in the art, as disclosed for example in U.S. Pat. No. 3,063,877, and U.S. Pat. No. 3,450,579, and forms no part of this invention. Following the after rinse the coated panels are dried and are then ready to receive paint or lacquer.

While it has been discovered that the phosphate coating process of this invention may be utilized within wide ranges of molar concentration of calcium, pH's and temperature, this is not to say that any combination of these three components within these disclosed ranges will be useful. On the contrary, it has been discovered that, for calcium phosphate to be deposited as a satisfactory coating, a critical range relationship between these components must be followed.

The parameters of concentration, pH, and temperature must be selected in such a manner that the coating bath is maintained at a pH which is as close as possible to, but does not exceed, the saturation point of calcium phosphate at that concentration and temperature. In most examples this means a pH above 3.0.

Thus, for example, in a second illustration of the process of this invention, the bath solution of the foregoing example which is 0.025 molar in calcium could be utilized with a bath temperature of for example, 77° F. in which case a pH of up to 4.2, and no higher, would be allowable.

It should be understood, however, that the pH levels which may be utilized in the process of this invention are critical only at their upper limit. That is to say, while a pH above about 3.0 is desirable as a lower pH to insure a sufficient delivery of calcium phosphate in a reasonably short period of time, the criticality referred to in this invention means the pH may not exceed at its upper limit, the saturation pH at that temperature and concentration utilized.

Ferrous metal surfaces coated with calcium phosphate in accordance with the method of this invention compare favorably with panels coated with zinc phosphate and iron phosphate.

In a comparison test example five sets of steel panels of approximate size 4inches × 12 inches were cleaned, rinsed and then coated according to the process of this invention by spraying them with a coating solution of calcium phosphate containing 0.025 moles/liter calculated as $Ca^{++}$ *and various amounts of sodium nitrite at various pH's. The temperature of the coating solution was* 100° F., and the spray time was 60 seconds.

The physical properties of the test panels after preparation and before testing are summarized in Table I and represented as a single number, but it should be appreciated that this number is generally an average of two or three test runs.

TABLE I

| Panel | 1 Total Acid (points) | 2 $NaNO_2$ (ppm) | 3 pH | 4 Coating Wt. ($mg/ft^2$) | 5 Iron Loss ($mg/ft^2$) | 6 Effy. |
|---|---|---|---|---|---|---|
| A | 8.8 | 217 | 3.30 | 30.3 | 93.9 | 0.32 |
| B | 8.8 | 229 | 3.65 | 34.5 | 72.9 | 0.47 |
| C | 8.4 | 236 | 3.80 | 27.3 | 66.6 | 0.41 |
| D | 8.7 | 279 | 4.02 | 27.0 | 40.2 | 0.67 |
| E | 8.6 | 248 | 4.20 | 26.7 | 39.6 | 0.67 |

In Table I, column 1 indicates total acid points which is a measurement of the number of milliliters of 0.1 molar sodium hydroxide required to neutralize a 10 cc bath sample to a phenolphthalein end point. Total acid points are used to indicate the phosphoric acid concentration. Column 2 shows the amounts of sodium nitrite accelerator utilized measured in parts per million. Column 3 indicates the various pH units utilized. Column 4 indicates the weight of coating deposited on the panel as measured in milligrams per square foot. Column 5 indicates iron loss from the panel as a result of the process of this invention measured in milligrams per square foot. Column 6 gives the coating efficiency which is a ratio of coating weight/iron loss.

These five panels were utilized in tests as outlined in Table II. Table II contains data on corrosion resistance of the panels as measured in a salt water spray test and a water immersion test as compared to zinc phosphate coated panels and iron phosphate coated steel panels as standards.

The zinc phosphate coated standard panels were coated from a coating solution prepared by dilution of the following concentrate:

| Constituent | Amount (by weight) |
|---|---|
| Zinc oxide | 12.51% |
| 75% Phosphoric acid | 58.14% |
| Nickelous oxide | 1.12% |
| Sodium chlorate | 3.85% |

-continued

| Constituent | Amount (by weight) |
|---|---|
| Water | to 100% |

This concentrate was diluted to give a coating solution concentration of 1% (by volume) which is about 0.025 molar zinc. The coating solution was applied to the panel to give a coating weight of approximately 250 mg/ft$^2$.

The iron phosphate coating solution used as a standard for panels was prepared from a concentrate consisting of:

| Constituent | Amount (by weight) |
|---|---|
| 75% Phosphoric acid | 27.94% |
| Soda ash | 8.40% |
| Sodium chlorate | 11.66% |
| Water | to 100% |

This concentrate was employed in aqueous solution at a concentration of 3.3% (by volume) which is about 0.1 molar in phosphate, and the panels after coating had a coating weight of approximately 40 mg/ft$^2$.

The zinc phosphate and iron phosphate standard panels shown in Table II also represent an average of two or more panels.

The five sets of test panels whose properties and specifications are listed in Table I together with the two sets of standard panels were subjected to the following tests under the following described test conditions. The panels were coated with various commonly used test paint primers plus top coat and some of the thus coated panels were scribed through the coating layers to bare metal. All the panels were then subjected to a salt spray or water immersion test and the results are summarized in Table II.

TABLE II

| | Corrosion rating | | | | | | |
|---|---|---|---|---|---|---|---|
| Paint system | 1 | 1 | 1 | 1 | 1 + TC | 2 | 2 |
| Test used | SS | SS | SS | SS | SS | SS | WS |
| Length (hrs.) | 96 | 168 | 240 | 336 | 336 | 240 | 240 |
| Scribed panels | No | No | No | No | Yes | Yes | Yes |
| Panel | | | | | | | |
| A | 10 | 9.7 | 8.3 | 7.2 | 10 | 10 | 10 |
| B | 10 | 10 | 10 | 8.0 | 9.7 | 10 | 10 |
| C | 10 | 10 | 9.0 | 9.0 | 9.9 | 10 | 10 |
| D | 10 | 9.8 | 9.2 | 8.7 | 9.9 | 9.9 | 10 |
| E | 10 | 9.8 | 9.2 | 8.7 | 9.9 | 9.9 | 10 |
| iron phos. standard | 10 | 8.7 | 7.7 | 7.7 | 9.0 | 9.0 | 10 |
| zinc phos. standard | 10 | 8.0 | 8.0 | 8.0 | 8.3 | 10 | 10 |

In Table II, reading across, beginning with the top row, Paint system 1 and Paint system 2 refer to paint systems employed by the auto industry as standards to test the efficacy of proposed new phosphate or phosphate type coatings. System 1, currently employed by General Motors, consists of a PPG water-based paint applied electrophoretically as a primer. System 1 plus TC utilizes the aforesaid prime coat plus an E. I. duPont de Nemours spray surfacer and spray topcoat for a total of three coats of organic finish. System 2 currently used at Ford Motor Company, utilizes a solvent based first and second primer and an internally developed Ford Motor Company top coat. In the "Test used" row, "SS" refers to a standard salt water spray test as described in detail in the American Society of Testing Materials Bulletin No. ASTM-B 117. "WS" refers to a standard water immersion test, also an American Society of Testing Materials test, described in their Bulletin No. ASTM-D 870. Length refers to the duration of the exposure, measured in hours.

"Scribed" indicates whether the panel was scribed or not and the purpose of this test is to evaluate the extent of the corrosion emanating outwardly into the painted area from the exposed metal of the scribe mark. Panels A through E and the two control panels have already been described.

The rating of the panels is done visually on a scale averaging from 1 to 10 with 10 representing the best results.

As can readily be seen from Table II, the calcium phosphate coated panels of this invention give results overall which are equal to and sometimes superior to prior art phosphate coated panels under the same test conditions.

Variations exist within the critical ratios disclosed as the scope of this invention.

While the process of this invention is most efficiently operated at a pH as close as possible to the saturation point for calcium phosphate at that temperature and concentration, a lower pH may be utilized with proper temperature and calcium concentration adjustments. However, in most operations at a pH below 3.0 the coating efficiency (coating weight/iron loss) falls off markedly and the process becomes impractical since too much iron is removed from the surface during the coating process.

Conversely, it has been found that the coating efficiency increases with increasing pH up to the pH of the saturation point for calcium phosphate. However, above this pH e.g. supersaturation, the calcium acid phosphate becomes less stable in solution than is desirable for a practical phosphating process and, accordingly, saturation represents the upper limit of pH for the process of this invention.

The concentration of calcium phosphate utilizable in the process of this invention is a matter of choice within the 0.01 to 1.0 molar calcium ($Ca^{++}$) range disclosed. For many large scale industrial processes, a 0.025 to 1.0 molar solution is preferable. Accordingly, within the parameters as disclosed, this means that a pH from about 3.4 to about 4.0, and most preferably within the narrow range of 3.7 to 3.8 is preferred. This narrow range has been found to give particularly excellent results in terms of corrosion resistance and paint bonding characteristics of the coating formed, and at a low rate of iron loss from the surface in forming the coating.

In regard to the temperature, the range of from about 50° F. to about 160° F. is satisfactory within the appropriate pH and concentration limitations. Inasmuch as the coating efficiency increases with the temperature, below 50° F. the efficiency of the coating process is too low to be practical. Within the 50° F. to 160° F. temperature range the coated surfaces produced show excellent properties. Obviously, the higher the temperature employed for the bath the greater the expenditure in energy to operate the process, and above 160° F. the coating formed may not merit the extra expenditure of energy, although it is possible to utilize the process at the boiling point of the solution. However, the temperature range which offers the optimum compromise between coating efficiency and energy expenditure is the range of from 50° F. to about 160° F. and within this range the narrower range of about 90° F. to about 120° F. is preferred.

As has been indicated previously, it is generally necessary to add a pH adjusting agent to raise the pH of the bath to the appropriate pH. In this connection, it should be pointed out that the bath solution of the process of this invention is conveniently prepared first as a concentrate such as that illustrated in Example I. The concentrate should, in general, be prepared at a lower pH than the bath to be used because a lower pH insures a better shelf-life for the material. Thus, it may be noted that the concentrate utilized in Example I was prepared so that there is approximately three phosphate ($PO_4^{\equiv}$) anions for every one calcium ($Ca^{++}$) cation supplied. This ratio has been found to insure good shelf-life with little or no deterioration of the product over an extended period of time.

Satisfactory pH adjusting agents include any alkaline material which raises the pH but does not interfere with the coating operation. Examples of suitable pH adjusting agents include calcium carbonate, sodium hydroxide, potassium hydroxide, ammonium hydroxide, sodium carbonate and potassium carbonate. Calcium carbonate is, however, preferred.

The oxidizing agents (also known as accelerating agents) employed in the process of this invention are necessary to achieve a satisfactory coating at the high pH utilized in the process of this invention. Sodium nitrite is a preferred accelerator, but other oxidizing agents such as alkali metal chlorates particularly sodium chlorate, hydroxylamine salts, nitrobenzene sulphonate, peroxides, and others as are well known in the art may be substituted. When using sodium nitrite in the coating solution of this invention, it has been found, surprisingly, that a very low concentration of nitrite is sufficient to give excellent results. That is to say, anything more than a trace of nitrite in the coating solution is sufficient to produce the desired results. However, for practical purposes a lower limit of about 20 parts per million of the nitrite (calculated as sodium nitrite) is preferred.

As the concentration of nitrite is increased the coating weight obtained from the coating solution also increases, but since the iron loss also increases, the coating efficiency remains substantially the same. Investigations have also shown that the quality of coated surface obtained, in terms of its corrosion resistance and paint holding characteristics, is not improved by increasing the amount of nitrite in the coating solution, and therefore, it is preferred that the nitrite content be not greater than 300 ppm (calculated as sodium nitrite), since this gives satisfactory results without unnecessary etch of the ferrous metal surface and without pointless expenditure on more materials for the coating solution. Particularly good results have been obtained where spray coating is employed with a nitrite content (calculated as sodium nitrite) of less than 100 ppm and the preferred range is as low as from about 30 to about 80 ppm. It is pointed out that these ranges of nitrite content are the preferred ranges from the point of view of economics of the process, and that if desired concentrations of nitrite higher than 300 ppm could be employed.

When the ferrous metal surface is contacted with the coating solution using dip techniques rather than spray techniques, the preferred accelerator is nitrite, and particularly sodium nitrite. When sodium nitrite is used as an accelerator for a dip technique the preferred concentrations are substantially the same as those specified above for spray techniques. Chlorates may also be used in the dip technique and have been found to give considerably better results than when used in a solution applied by spraying. The preferred chlorate is sodium chlorate, and the preferred concentrations for use with a dip technique are from about 0.5 to about 2.0% (by weight) sodium chlorate.

The oxidizing agent is conventionally added to bath before the pH adjusting step but this order of addition is not essential. It should be understood that the oxidizing agent may be added any time during the process of this invention prior to commencing the treatment of the metal.

The time of contact between the coating solution and the ferrous metal surface to be coated is, of course, dependent upon the application technique employed. It is believed to be within the competence of one skilled in the art to determine, for any particular technique, practical ranges for the time of contact in order to give a satisfactory coating. However, by way of illustration, it is pointed out that when contacting the ferrous metal surface with the coating solution using a spray technique, a spray time of 30 seconds and greater has been found to be effective with conventional equipment. Particularly good results have been obtained using a spray time of approximately 60 seconds.

When using a dip technique to contact the ferrous metal surface with the coating solution, a longer contact time is required. Typical contact times when employing a dip technique range from about 1 minute to about 20 minutes, although a time of about 10 minutes has generally been found to be satisfactory.

The process of this invention has many advantages. Chief among these, as has been pointed out, is the ability to substitute the less expensive calcium phosphate coating for the prior art zinc phosphate coating in a process where low temperatures may be employed. Furthermore, the process of this invention achieves economics in that, even though a low temperature process is employed, it is no longer a requirement to utilize a supersaturated solution with its inherent instability and concomitant sludge problems.

Finally, the superior properties of coatings produced by the process of this invention are surprising in that such excellent results in terms of corrosion resistance and paint bonding characteristics are obtained with such a relatively small coating weight, typically less than 50 mg/ft$^2$, and frequently within the range of 10 to 40 mg/ft$^2$. This coating weight is to be contrasted with conventional phosphating processes which form heavier coatings, typically of the order of 200 to 300 mg/ft$^2$ in the case of zinc phosphate, 20 to 100 mg/ft$^2$ in the case of iron phosphate, and 1000 to 5000 mg/ft$^2$ in the case of manganese phosphate.

While the invention has been illustrated and described in detail, such description is not exhaustive of possible permutations encompassed within the scope of this disclosure. It is not intended for the invention to be limited to only those specific embodiments disclosed but rather only by a reasonable interpretation of the appended claims.

What is claimed is:

1. A method of producing an amorphous, light weight, tightly adherent calcium phosphate coating on a ferrous metal surface comprising applying, at a temperature of from about 50° F to about 160° F., to a metal surface a coating from an aqueous coating solution consisting of an aqueous solution of calcium phosphate and an oxidizing agent, in which the calcium phosphate is present in an amount of from about 0.01 to about 1.0 moles per liter as measured by the $Ca^{++}$ cation and in which the pH of the solution is between about 3.0 and about 4.2 and said pH is as close as possible to, but does not exceed, the saturation pH of the calcium phosphate at said concentration and said temperature.

2. A method according to claim 1 in which the calcium cation of the calcium phosphate is supplied in the form of calcium carbonate.

3. The method according to claim 1 wherein the phosphate anion of the calcium phosphate is supplied in the form of an aqueous phosphoric acid solution.

4. The method according to claim 1 in which the temperature is between about 90° F to about 120° F. and the pH of the aqueous coating solution is between about 3.7 and about 3.8.

5. The method according to claim 1 in which the oxidizing agent is selected from the group consisting of alkali metal nitrites and alkali metal chlorates.

6. The method according to claim 5 wherein said oxidizing agent is an alkali metal nitrite present in an amount of less than about 200 ppm.

7. The method according to claim 6 wherein said alkali metal nitrite is sodium nitrite and wherein said amount of sodium nitrite present is between about 30 to about 80 ppm.

8. The method according to claim 1 in which the aqueous coating solution is applied to the metal surface by spraying said solution on said metal surface.

9. The method according to claim 1 in which said aqueous solution is applied to the metal surface by immersing said metal surface into said solution.

10. The method according to claim 1 wherein said calcium phosphate coating is applied to a thickness of less than about 50 milligrams per square foot.

11. The method according to claim 1 in which said aqueous coating solution of calcium phosphate is derived from a concentrate in which the calcium phosphate is present in the concentrate in a ratio of about 1 calcium cation for every 3 phosphate anions.

12. The method of claim 1 in which the aqueous coating solution is derived from a concentrate comprising:

from about 5% to about 20% calcium carbonate
from about 10% to about 60% phosphoric acid.

13. The method of claim 12 in which the concentrate contains by weight about 9% calcium carbonate and about 30% phosphoric acid.

14. A method of producing an amorphous, light weight, tightly adherent calcium phosphate coating on a ferrous metal surface comprising:

(A) providing an aqueous solution consisting of from about 1.0 to about 5.0 grams/liter of calcium carbonate, from about 3 to about 15 grams/liter phosphoric acid, and from about 0.05 to about 0.30 grams/liter sodium nitrite, wherein the pH of said aqueous solution is between about 3.0 and about 4.2 and is as close as possible to, but does not exceed, the saturation pH of calcium phosphate at the solution temperature of (B);

(B) heating said solution to from about 90° F to about 120° F.;

(C) applying said solution to said ferrous metal surface for a time sufficient to deposit thereon a noncrystalline, bonded coating of calcium phosphate to a coating thickness of less than about 50 milligrams per square foot of metal surface.

* * * * *